US005720484A

United States Patent [19]

Hsu

[11] Patent Number: 5,720,484

[45] Date of Patent: Feb. 24, 1998

[54] METHOD OF PLAYING A CASINO CARD GAME

[76] Inventor: James Hsu, 5762 Galvin Rd., Traverse City, Mich. 49684

[21] Appl. No.: 752,043

[22] Filed: Nov. 19, 1996

[51] Int. Cl.[6] ..... A63F 1/00

[52] U.S. Cl. ..... 273/292; 273/274

[58] Field of Search ..... 273/292, 309, 273/274, 303–306

[56] References Cited

U.S. PATENT DOCUMENTS

| | | | |
|---|---|---|---|
| 4,651,997 | 3/1987 | Wood | 273/274 |
| 4,659,087 | 4/1987 | Shen et al. | 273/274 |
| 4,836,553 | 6/1989 | Suttle et al. | 273/292 |
| 5,257,810 | 11/1993 | Schorr et al. | 273/292 |
| 5,275,415 | 1/1994 | Wisted | 273/274 |
| 5,275,416 | 1/1994 | Schorr et al. | 273/292 |
| 5,314,193 | 5/1994 | Ferrer | 273/292 |
| 5,328,189 | 7/1994 | Malek | 273/292 |
| 5,368,305 | 11/1994 | Rodda et al. | 273/292 |
| 5,415,414 | 5/1995 | Savage | 373/306 |
| 5,437,462 | 8/1995 | Breeding | 273/292 |
| 5,452,899 | 9/1995 | Skratulia et al. | 273/292 |
| 5,489,101 | 2/1996 | Moody | 273/292 |
| 5,529,309 | 6/1996 | Bartlett | 273/292 |
| 5,531,448 | 7/1996 | Moody | 273/292 |

OTHER PUBLICATIONS

Scarne's Encyclopedia Of Games, John Scarne, Harper & Row Publishers, pp. 23–26, 310–311, Dec. 1973.

*Primary Examiner*—Benjamin H. Layno
*Attorney, Agent, or Firm*—Young & Basile, P.C.

[57] ABSTRACT

A method for playing a card game having a dealer and at least one player, wherein the dealer deals two cards facing up to each player and at least two cards to the dealer, one card dealt face up and the other card or cards dealt after the playing of the players' hands. Each player arranges his cards within a boxed-in area located in front of the player having four rectangles therein. The four rectangles define two rows and two columns to provide four lines of chances for matching a winning number. The winning number is determined by the addition of the dealer's two cards and may also include a second winning number determined by the difference of the dealer's two cards. The game provides conditions for a second chance game for players who do not win with the dealer's first two cards.

14 Claims, 1 Drawing Sheet

METHOD OF PLAYING A CASINO CARD GAME

FIELD OF THE INVENTION

The invention relates to a card betting game suitable for casino play and adaptable for electronic machine play.

BACKGROUND OF THE INVENTION

Of all the live table games of chance played in U.S. casinos over the past 35 years, the most popular by far has been Blackjack. All other casino-banked table games have a built-in mathematical casino advantage which cannot be overcome through any skill on the part of the player. The main reason for Blackjack's popularity is that the game can be mathematically beaten through skill on the part of the player. The game offers strategy choices which are based on mathematical principles rather than arbitrary hunches, such as in Craps, Roulette, Baccarat, and Keno. Other games offer some strategy choices based on skill, but in every case even the most skillful player cannot overcome the house advantage. Yet despite the fact that the skillful Blackjack player can actually have a mathematical advantage of 1% or more over the house, Blackjack has remained the most profitable table game for casinos! This paradox may be due to the fact that although players are attracted to Blackjack because of its feature of giving players control over their own destiny, the average player lacks the discipline required to become skillful enough to consistently beat the game.

As good a game as Blackjack is, it has some undesirable features. For one thing, the decisions of one player can inadvertently affect the outcome of other players' wagers, sometimes causing ill feelings among players at a table. This serves to intimidate many players and makes them less likely to play the game. The main drawback of Blackjack, however, is that there exists enough skillful Blackjack players called card counters who can beat the game to a substantial enough degree that, if allowed to play unimpeded, they would erase most, if not all, of the casinos' profits from the game. For this reason, casinos have found it necessary to use countermeasures to impede the full usage of players' skill. Such countermeasures include selectively shuffling the cards when the players are thought to have an advantage, applying "heat" to winning players thought to be skillful by intimidating them into thinking that if they continue to win they will be barred from further play, and actual barring of winning individual players from the casino. These countermeasures create a public relations problem for casinos not only by alienating those gamblers who finally hit a lucky streak only to be mistaken for a card counter, but also by creating the public perception that casinos only welcome losers and will not tolerate winners. A lot of casino manpower is also required to remain ever vigilant for skillful Blackjack players, thereby taxing casino resources.

Therefore, the casino gaming industry needs a game with the advantages of Blackjack but without the disadvantages. That is, the game should allow meaningful strategic choices based on skill rather than chance. The game should further allow a skillful player to be able to completely overcome the house advantage. The Blackjack experience has shown that players are particularly attracted to this feature, even though the majority are unable to take full advantage of it, and therein lies the casinos' profits. The game should be simple to play, but deceptively difficult to beat, and not be beatable to a large enough degree to hurt the casinos' profits. Casinos should not have to fear the expert players when playing the game, and therefore heavy-handed countermeasures should be unnecessary. Casino personnel can be genuinely happy when players beat the game since they do not need to fear for their profits. The game should create the type of win-win playing atmosphere conducive to having fun and generating repeat business. An additional desirable feature of the game should make a player's playing decision impact only his own bet and not affect the bets of other players, to further eliminate player discord.

It is an object of the present invention to address the aforementioned concerns.

SUMMARY OF THE INVENTION

In the card betting game of the present invention, all players play against the house and not against each other. The game is played with one or more standard decks of playing cards. The game includes dealer and at least one player. Each player makes an initial bet. The dealer then deals two cards face up to each player. The dealer also deals two cards to himself, the first card to the dealer is dealt face up and the second card is not revealed to the players until each player has finished playing his hand. Each card from Ace to ten is worth its face value for points. The Jacks, Queens, and Kings are worth ten points each. Using his two cards, each player tries to match one or more winning numbers which will subsequently be determined by the dealer's two cards. Each player arranges his two cards anywhere in a grid of four rectangles having two rows and two columns each. The card points in each row are summed as well as the card points in each column, resulting in four separate sums. The two empty spaces where the two cards are not placed have a value of zero. Each row or column which contains a sum that matches the winning number determined by the dealer's two cards is called a winning line. The sum of the dealer's two cards is always one winning number. If the sum of the dealer's two cards is greater than a predetermined number, the difference between the dealer's two cards is an additional winning number. The difference between the dealer's two cards is obtained by subtracting the smaller card from the greater one in order to obtain a positive number.

If the dealer's initial face up card dealt at the time the player's hands are dealt equals certain predetermined denominations, and the player is found to have no winning line after the dealer's second card is revealed, then a third card is dealt to the dealer, and the second card is put out of play. A new winning number is determined using the first and third dealer cards.

The game of the present invention is designed to retain the appeal of Blackjack by being mathematically beatable, but without the drawback of being beatable to such a high degree that the casino needs to be concerned about its bottom line.

The feature of Blackjack mainly responsible for its large degree of beatability is the fact that the card denominations are "unbalanced" in their worth to the player. Aces and ten-value cards are good cards for the player, and 2's through 6's are bad for the player. If the player can identify when the unplayed portion of the shoe is rich in aces and ten-value cards, then he knows before his next hand is dealt that he has a mathematical advantage over the house, and he can make a large bet. When he sees that there is greater than the usual proportion of 2's through 6's left in the unplayed portion of the shoe, he knows he will have a mathematical disadvantage on his next hand, so he makes as small a bet as possible. In this manner, he can beat the house in the long run even without winning a majority of his hands. He profits by winning the majority of his big bets while losing the majority of his small bets.

In the present invention, the card denominations are very nearly equal in their worth to the player, so that the player cannot identify before his hand is dealt whether or not he has an advantage to any significant degree. Although the game is not played like Blackjack, an analogous mathematical analysis can be made for comparison. Assume that a hypothetical Blackjack card counter has a $20,000 bankroll. Whenever he knows he has no mathematical advantage he bets $2. When he does have an advantage he bets a percentage of his bankroll proportional to the size of his mathematical advantage. This is the mathematically optimal technique for maximizing one's financial gain, and will result in some bets as high as $508.00. In a four-deck Blackjack game in which 75% of the shoe is dealt out before each shuffle (shuffle with 52 cards remaining out of the original 208), with typical Las Vegas Strip rules, he can theoretically average a profit of $81.15 per 100 hands. This is why casinos cannot afford to allow Blackjack players to vary their bets in this manner, and countermeasures would have to be used. A card counter playing the game of the present invention under the same conditions would average a profit of $3.87 per 100 hands, an amount insignificant enough that countermeasures would be unnecessary. When card counting is not used, the game of the present invention can be played essentially even with the house with the perfect execution of a non-counting playing strategy. This has been verified by computer simulations playing 127 million hands. When played with the strategy errors typical of the average gamer, the mathematical edge moves quickly in favor of the casino.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
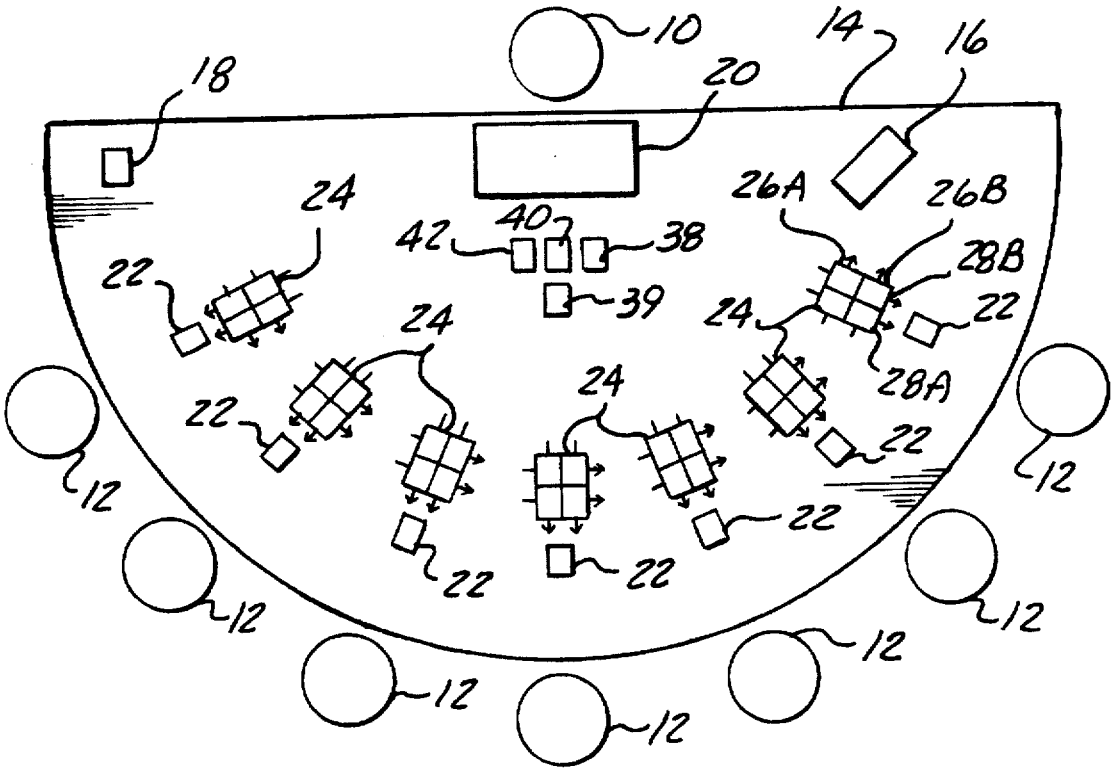
FIG. 1 is a gaming table layout showing an actual arrangement.
Figure 2:
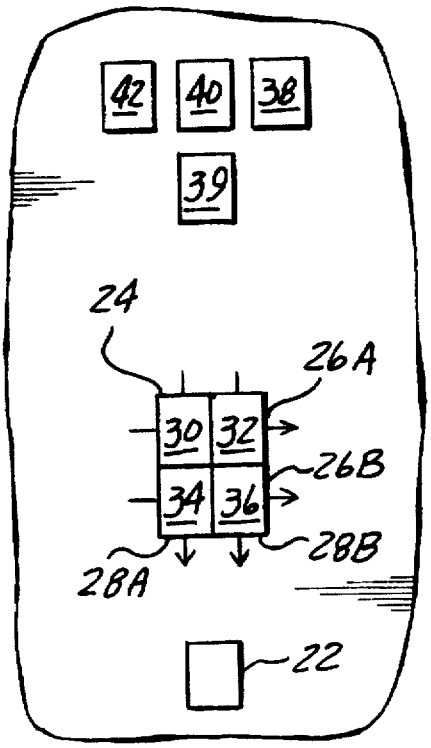
FIG. 2 shows an enlarged view of the positions for the dealer's and player's cards on the gaming table.

The invention is a card game that may be played at a semi-circular table 14 similar to that shown in FIG. 1. The dealer's position 10 is provided in view of the players 12. One or more players 12 may participate. The players 12 are located around the semi-circular portion of the table 14. Proximate to the dealer's position 10, there is located a dealing shoe 16 near one corner and a discard tray 18 in an opposing corner. In front of the dealer 10 will generally be located a chip tray 20. Also in front of the dealer 10 there are indicated areas or spots for the dealer 10 to position his or her cards as dealt during the play of the game. These areas will be discussed in detail further.

Directly in front of each player 12 is a wagering area 22 that may be identified by an associated symbol. In front of each wagering area 22 for each player 12 and toward the dealer 10 is a boxed-in portion 24 divided into four sections. The four sections are defined as four rectangles forming two rows 26A and B and two columns 28A and B.

One or more complete standard decks of playing cards, numbering 52 cards per deck, are used. The number of decks used does not affect the play of the game, but it does affect the player's odds of winning. Generally, from one to six decks may be used. The entire supply of cards is shuffled together before play begins. The shuffled cards are stored in the dealing shoe 16. After each hand is played, the used cards are placed in the discard tray 18 and dealing continues from the supply of unplayed cards in the dealing shoe 16. At some point before all of the unplayed cards are dealt out, called the "shuffle point," the entire supply of cards, both dealt and undealt, is reshuffled together in preparation for continuing play. The placement of the shuffle point, and therefore the number of undealt cards remaining at the time of reshuffling, may be determined by the casino. Varying this shuffle point affects the odds of winning for skilled players 12 called "card counters" who keep track of the cards which have been played since the most recent shuffle. The closer to the end of the dealing shoe the shuffle point is placed, the fewer the undealt cards remaining at the time of reshuffling, and the greater the advantage for card counters. Although this game is a difficult one for card counters to gain a significant advantage over the casino, nevertheless the placement of the shuffle point will affect the magnitude of that advantage.

The point value of each card is the same as its face value for cards Ace to ten. Aces always count as one point and the picture, face, or court cards (Jacks, Queens, Kings) all count as ten points. Suits have no effect on the card values.

Each round of play begins by each player 12 placing a wager in front of himself or herself at a designated wagering spot 22 on the playing surface of table 14. The dealer 10 then deals one initial card face up to himself and two cards face up to each player 12. The cards dealt to the players 12 will be placed in rectangles 34 and 36 of the boxed in section 24 in front of each player 12. The dealer's initial card is referred to as the "up card" and is positioned in designated area 38 or 39. In the preferred embodiment if the "up card" is from an ace through a five, the card is placed in area 38. If the "up card" is from a six through a King, the card is placed in area 39. The second dealer card, referred to as the "hole card", will later be dealt face up in designated area 40 after all the players 12 have finished playing their hands. After the hands are dealt, each player 12 decides on an arrangement of his two cards in the rectangular sections 30, 32, 34, 36 located in front of each player 12 in such a way as to try to maximize his chances of matching a winning number. The movement of the cards can be either by the players themselves 12 or by the dealer 10. It is advantageous of the casinos to allow only the dealer 10 to move cards after being dealt. The player's two cards may be placed into any of the four rectangles 30, 32, 34, 36 of the boxed-in portion 24 arrangement, one card per rectangle. Any card or cards placed in row 26A will be added together to achieve a sum, empty rectangles count zero points. Any card or cards placed in row 26B will be added together to achieve a separate sum. Likewise, column 28A and column 28B will each contain a sum. A sum in any row or column will be zero if no cards are in that row or column. Rows and columns necessarily intersect with each other, so that a particular card will always be a member of both a row and a column. Rows and columns are collectively called lines. The sums of the cards may only be added together in horizontal and vertical lines, and never diagonally. If the dealer 10 is the only one to move cards, then the player 12 can indicate to the dealer 10 to move his card.

Then the dealer 10 need only to move one of the cards in rectangles 34 and 36 to a position in row 26A. That is, the dealer 10 would move the card in rectangle 34 to rectangle 30 or move the card in rectangle 36 to the rectangle 32. The outcome would remain the same.

The object of the game is for each player to arrange his two cards within the rectangles 30, 32, 34, 36 so that the sum of the card points in at least one line (column or row) matches a winning number. The winning number, of which there may be more than one, is/are determined as follows: After all of the players 12 have finished playing their hand and have arranged their two cards within the desired rectangles 30, 32, 34, 36, the dealer 10 deals his second card (hole card) to himself, placing it face up in rectangle 40. The dealer's up card in designated area 38 or 39 and hole card 40 are then added together to determine one winning number. If the sum of the dealer's two cards totals 11 or more, then the difference between the dealer's two cards expressed as a positive number is also a winning number, in which case there would be two separate winning numbers. If the sum of the dealer's two cards is less than 11, then only their sum can be a winning number, and in that case there is only one winning number. If the dealer's two cards have the same point value and their sum equals 11 or more, i.e., the cards are both sixes or higher, then zero (the difference between the two cards) can also be a winning number. Since all of the court or picture cards are worth ten points each, a ten, Jack, Queen, and King may be subtracted one from another to equal zero, even though their denominations are not identical. A player's row 26A and 26B or column 28A and 28B whose point total matches a winning number is called a "winning line." A player's two cards can only be added and never subtracted to determine a winning line. It should be noted that the player only has two choices for arranging his cards, that is, he may either place them in the same line, or place them in different lines, that is, diagonally, as discussed supra.

During the play, if the player 12 leaves his cards in the same line, then he is capable of winning an amount equal to his original bet whenever he has at least one winning line. His payoff stays the same at even money regardless of the number of winning lines. If he has no winning lines, then he loses his original bet. If the player 12 chooses to place his cards diagonally, the player must place an additional bet equal to exactly one-half of his original bet, no more and no less. In this situation, the player will win an amount equal to his total bet for each one of his winning lines. If there are no winning lines, the player will lose both his original bet and his additional bet.

In the preferred embodiment, and in the event that the dealer's up card 38 is an Ace through five and the player 12 has no winning line, a second chance game will be available to that player 12. When the dealer 10 originally deals his up card to himself, he will place the card in designated area 38 to indicate to the players 12 that a second chance game will be available. In the situation of a second chance game, the dealer 10 must discard his original hole card and deal himself a second hole card in designated area 42. The winning numbers are recalculated using the original up card 38 and the new hole card 42 in the same way as with the first hole card 40. At this point the player 12 may not have his cards rearranged between the dealing of the first 40 and second hole cards 42. Therefore, only if the player 12 has no winning lines with either the first or second hole cards does he lose his bet. If a player already has at least one winning line on the first hole card 40, then he receives his winnings, his cards are removed from the playing surface and he does not participate in the continuation of the second chance game with the second hole card 42 for the benefit of subsequent players 12 who had no winning lines with the first hole card 40. If the dealer's up card is a six through King, the dealer 10 will place his up card when dealt in the designated area 39, to indicate to the players 12 that there will be no second chance game.

If a player's two cards form certain combinations, he may win even money automatically and does not play his hand any further and is not subject to the dealer's cards. Automatic winners are any player's hand whose two cards have identical denominations, unless the denominations are a particular value, such as three's. If a player 12 has two cards having identical denominations with the particular numbers such as three's, then there is no automatic win and a hand must be played according to the aforementioned rules. Therefore, an automatic winner would be eligible having a hand of Queen-Queen, but not having a player hand of Queen-King. Even though Kings and Queens have the same point value, they are not of the same denomination. Only a player 12 could have a hand which is an automatic winner. The dealer 10 cannot automatically win, even if his hand consists of two cards of the same denomination.

Various modifications may be made by the casinos to alter the odds of winning. These modifications include using various numbers of complete decks of cards and adjusting the shuffle point of the decks, changing the amount required for the additional bet to include as little as zero, making payoffs of winning lines be multiples of the original bet rather than multiples of the total bet, and changing the requirement for automatic winners based upon the sum of the player's cards. Further modifications may include changing the minimum sum of the dealer's two cards necessary to allow that the difference of the two cards to be an additional winning number, allowing a second chance game if the dealer's up card is within a different group other than Ace through five, and dealing the first hole card face down at the beginning with the rest of the cards for exposure after the players have arranged their cards. It is to be noted that some of these modifications will change the casino house advantage, and are provided for use at the discretion of the casino. It should also be noted that this game is applicable for electronic machine play, wherein there may be only one player and the machine is the dealer.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for playing a card game having a dealer and at least one player comprising the steps of:

providing at least one deck of cards, each card having a specific numeral point value;

dealing two cards face up to each player in a particular arrangement;

dealing a card face up to the dealer;

if the player wishes, rearranging the two cards of the player in a second particular arrangement to form two columns and two rows;

adding the value of each card or cards on each column and on each row to provide four line numbers;

exposing a dealer's second card;

adding the values of the dealer's two cards to provide a winning number;

comparing the player's line numbers with the at least one winning number; and declaring the player a winner, if at least one player's line number matches the at least one winning number.

2. The method of claim 1 further comprising the step of:

determining a difference between the dealer's two cards if the sum of the dealer's two cards is greater than a first predetermined number, wherein the difference is a second winning number.

3. The method of claim 1 further comprising the step of:

providing a second chance game if the player has no winning line and the dealer's first card has a point value within a predetermined set.

4. The method of claim 3, further providing the step of dealing a third card to the dealer and using the dealer's first and third cards to determine at least one new winning number for the second chance game.

5. The method of claim 1 further comprising the step of:

placing a first wager by the player before dealing the cards.

6. The method of claim 5 further comprising the step of:

placing a second wager by the player if the player wishes to rearrange his two cards.

7. The method of claim 6, wherein the second wager is a proportion of the first wager.

8. The method of claim 7, further including the step of paying the winner an amount equal to one of the winner's first wager and a total of the winner's first wager and second wager.

9. The method of claim 6, wherein the second wager is zero.

10. The method of claim 1 further comprising the step of:

allowing the player to automatically win if he has a predetermined card combination.

11. The method of claim 10, wherein the predetermined card combination is certain identical denominations of the player's two cards.

12. The method of claim 10 wherein only the player may automatically win.

13. The methods of claim 1, further comprising the step of:

providing a playing surface, wherein said playing surface has a boxed-in area located in front of the player and said boxed-in area has four rectangles therein for placement of the player's two cards.

14. The method of claim 1, wherein the specific point value of each card is determined such that an Ace is one point, a face card is ten points, and all other cards are their point value.

* * * * *